US008584981B2

(12) United States Patent
Zenoni et al.

(10) Patent No.: US 8,584,981 B2
(45) Date of Patent: Nov. 19, 2013

(54) POSITIVE YARN FEEDER WITH TENSION LIMITER

(71) Applicant: L.G.L. Electronics S.p.A., Gandino (IT)

(72) Inventors: Pietro Zenoni, Leffe (IT); Giovanni Pedrini, Leffe (IT); Rosario Castelli, Gandino (IT)

(73) Assignee: L.G.L. Electronics S.p.A., Gandino (IT)

( * ) Notice: Subject to any disclaimer, the term of this patent is extended or adjusted under 35 U.S.C. 154(b) by 0 days.

(21) Appl. No.: 13/694,166

(22) Filed: Nov. 2, 2012

(65) Prior Publication Data

US 2013/0068872 A1 Mar. 21, 2013

Related U.S. Application Data

(62) Division of application No. 12/654,407, filed on Dec. 18, 2009, now Pat. No. 8,356,765.

(30) Foreign Application Priority Data

Dec. 30, 2008 (EP) ..... 08425821

(51) Int. Cl.
*B65H 59/36* (2006.01)
*B65H 51/20* (2006.01)

(52) U.S. Cl.
USPC ..... 242/417.1; 242/417.3

(58) Field of Classification Search
USPC ..... 242/364, 365.6, 416, 417, 417.1, 417.2, 242/417.3; 66/132 R, 146
See application file for complete search history.

(56) References Cited

U.S. PATENT DOCUMENTS

| | | | | |
|---|---|---|---|---|
| 3,962,891 | A | 6/1976 | Rouzaud | |
| 4,854,511 | A | 8/1989 | Montali et al. | 242/476.7 |
| 4,858,837 | A * | 8/1989 | Montali et al. | 242/476.7 |
| 2008/0148782 | A1 | 6/2008 | Minakata et al. | 66/126 A |

FOREIGN PATENT DOCUMENTS

| | | | |
|---|---|---|---|
| EP | 0 256 519 | A1 | 2/1988 |
| WO | WO 2005/111287 | A1 | 11/2005 |
| WO | WO 2008/078351 | A1 | 7/2008 |
| WO | WO 2009112221 | A1 | 9/2009 |

* cited by examiner

*Primary Examiner* — William E Dondero
(74) *Attorney, Agent, or Firm* — Modiano & Associati; Albert Josif; Daniel J. O'Byrne

(57) ABSTRACT

A motorized yarn-winding drum holds a plurality of loops of yarn wound thereon and is driven to rotate for drawing said yarn from a reel and feeding it to a general downstream machine. A movable guiding member is biased to slideably engage the yarn unwinding from the drum and to deviate its path, by a spring acting in contrast to the tension of the yarn, thereby generating a reserve releasable in response to tension peaks on the yarn. The stroke of the guiding member is limited by a stop defining a position of maximum deviation of the yarn. The spring has one end operatively connected to the guiding member and one opposite end connected to driving elements operable for applying a load to the spring, with the guiding member abutting against said stop. The driving elements are controlled by a control unit which is programmed to adjust the load as a function of a desired feeding tension.

3 Claims, 4 Drawing Sheets

POSITIVE YARN FEEDER WITH TENSION LIMITER

This is a divisional application of U.S. patent application Ser. No. 12/654,407 filed on Dec. 18, 2009.

The present invention relates to a positive yarn feeder for textile machines, of the type provided with a tension-limiting device for preventing tension peaks on the yarn.

BACKGROUND OF THE INVENTION

As known, in a general knitting using knitting machines and the like, the yarn may be fed to the downstream machine by a so-called "positive" yarn feeder. With this type of feeder, the yarn is wound on a motorized, yarn-winding drum, which draws the yarn from a reel and feeds it to the downstream machine.

It is desirable to measure and control the yarn tension along the knitting line in order to maintain it substantially constant and to prevent surging of tension, which may cause defects in the finished clothes and affect the production yield. Since this tension depends on the difference between the speed of rotation of the drum of the feeder and the drawing speed of the downstream machine, it is conventionally controlled by modulating the speed of rotation of the drum on the basis of a signal received from a tension sensor arranged downstream of the feeder, by means of a tension control loop. In other words, the variation of tension to be applied is converted into a difference between the yarn-feeding speed and the yarn-drawing speed which is set on the downstream machine.

Although the above system effectively operates in steady state, a drawback well known to the person skilled in the art occurs in the transient state at the start of the feeding process, when the yarn is subjected to tension peaks due to the relatively low quickness of movement of the yarn-winding drum with respect to the high quickness of drawing of the downstream machine.

In order to overcome the above drawback, it is known, e.g., from EP 0 256 519, to provide the yarn feeder with a tension-limiting device capable of storing a reserve between the feeder and the downstream machine, which reserve is releasable during the starting transients in order to prevent the above tension peaks. In the embodiment of EP 0 256 519, a reserve is formed by deviating the yarn from its natural path between two stationary eyelets, by means of a rigid bar connected to the driving shaft of a motor. At rest, as well as in steady state, the bar is positioned in such a way as to deviate the yarn from its natural path. In the transient state at the start of the feeding process, the bar is rotated in such a way as to temporarily release the yarn.

The above tension-limiting device requires very accurate control of the movement of the bar and, therefore, introduces considerable complications in the control system of the feeder, with consequent rise in costs.

A simpler system, which is very effective in reducing the tension peaks, is described in U.S. Pat. No. 3,962,891, wherein, likewise the previous system, a reserve is formed by deviating the yarn from its natural path between two stationary eyelets. Unlike the previous system, however, in U.S. Pat. No. 3,962,891 the yarn is not deviated "actively" by a rigid bar connected to a controlled motor, but "passively" by an arm integral with a flat spiral spring which is loaded to a predetermined tension. During the starting transients, the arm bends in contrast to the returning action of the spring and the reserve is released. At this stage, the yarn is maintained at a desired level of tension depending on the preload on the spring.

The above system is effective and easy to put into practice, but it has the drawback that, when it is desired to adjust the operative tension in relation to any variations of the feeding tension—which, as known, are managed in a fully automated way on the basis of the characteristics of the yarn, of the type of processing, of the type of downstream machine, etc.—the load of the spring must be manually adjusted, with consequent reduction of the degree of automation of the line.

SUMMARY OF THE INVENTION

Hence, it is a main object of the present invention to provide a positive yarn feeder provided with a tension-limiting device which is capable of adjusting its operative tension in a fully automated way on the basis of the parameters which are set on the knitting line.

BRIEF DESCRIPTION OF THE DRAWINGS

The invention will be now described in more detail with reference to a few preferred, non-exclusive embodiments shown by way of non-limiting example in the attached drawings, wherein.

DESCRIPTION OF THE PREFERRED EMBODIMENTS

Figure 1:
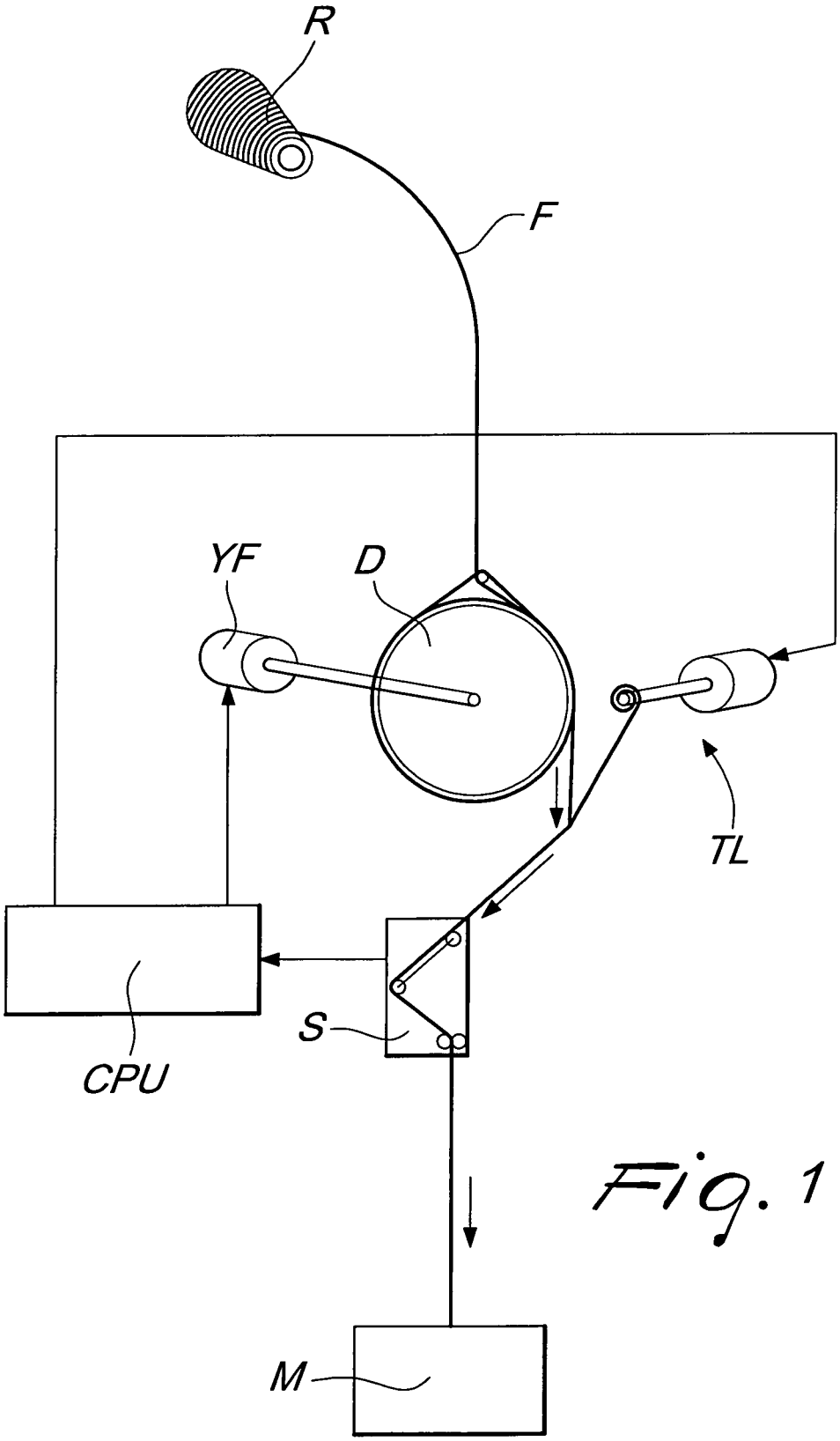
FIG. 1 diagrammatically shows a knitting line having a positive yarn feeder installed thereon provided with a tension-limiting device according to the invention.

FIG. 1 diagrammatically shows a knitting line in which a yarn F is wound on a rotating, yarn-winding drum D of a positive yarn feeder YF, which draws the yarn from a reel R and feeds it to a general knitting machine M.

The speed of rotation of drum D is conventionally managed by a control loop provided with a tension sensor S, which senses the tension of the yarn downstream of feeder YF and sends a corresponding signal to a control unit CPU. The latter is conventionally programmed to control the speed of feeder YF such as to maintain the feeding tension of yarn F substantially constant, which tension depends on the difference between the speed of rotation of drum D and the drawing speed of downstream machine M.

Feeder YF is provided with a tension-limiting device TL adapted to operate during the transients at the start of the feeding process, in order to prevent tension peaks due to the relatively low quickness of movement of the yarn-winding drum with respect to the high quickness of drawing of the downstream machine.

Figure 2:
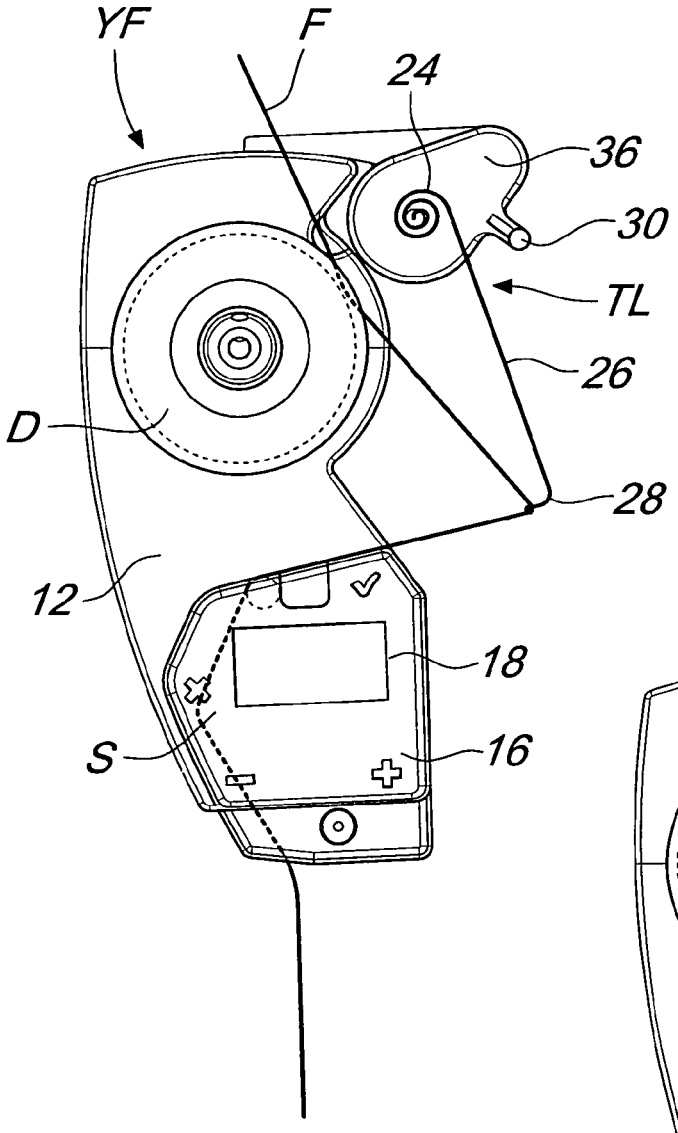
FIG. 2 is a detailed front view of the positive yarn feeder with tension-limiting device according to the invention.
Figure 3:
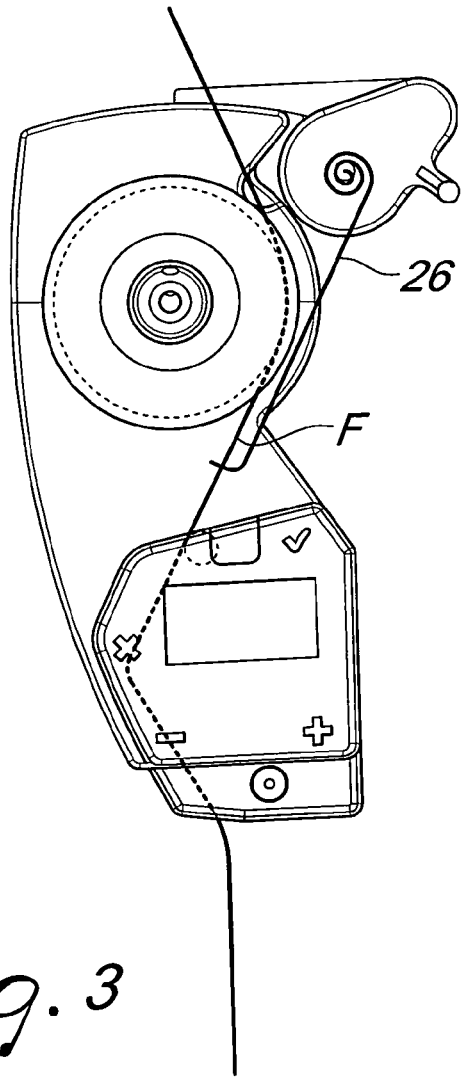
FIG. 3 is a view similar to FIG. 2 but showing the tension-limiting device in a different operative configuration.

Positive yarn feeder YF with tension-limiting device TL is shown in detail in FIG. 2.

Feeder YF comprises a housing 12 on which motorized drum D is supported. The operative parameters of feeder YF are set using a push-button panel 16 provided with a display 18. The yarn unwinding from drum D passes through tension sensor S, which is incorporated within feeder YF. Tension-limiting device TL comprises a flat spiral spring 24, whose outer end projects into a guiding member shaped as an arm 26 terminating with a hook-shaped end 28 which engages yarn F unwinding from drum D.

At rest, spring 24 biases arm 26 against a stop 30, at a position such that yarn F unwinding from drum D is deviated from its natural path, thereby forming a reserve which will be temporarily releasable during the above-mentioned starting transients. Arm 26, subject to the tension of the yarn, may rotate in contrast to the elastic return action of spring 24, thereby releasing the reserve. At this stage, the yarn is subject to an operative tension depending on the preload on spring 24.

Figure 4:
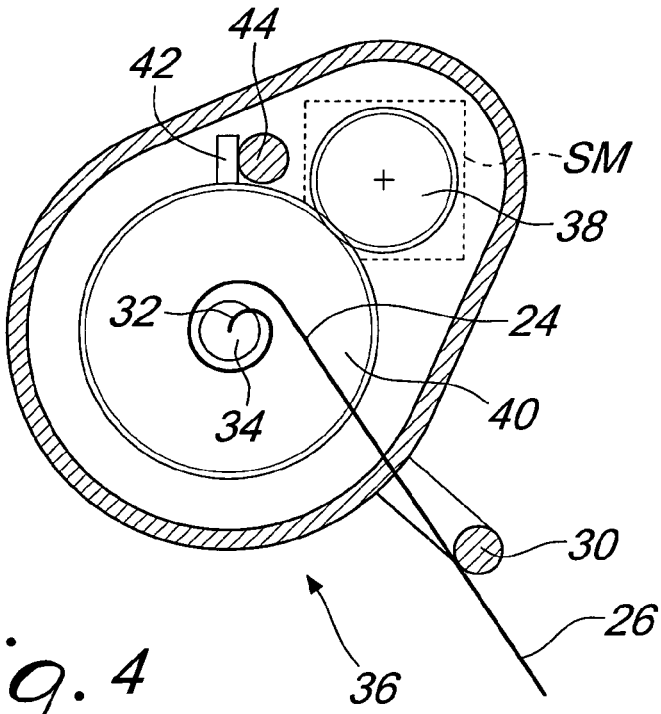
FIG. 4 is a broken-away view to an enlarged scale of the tension-limiting device of FIG. 2.
Figure 5:
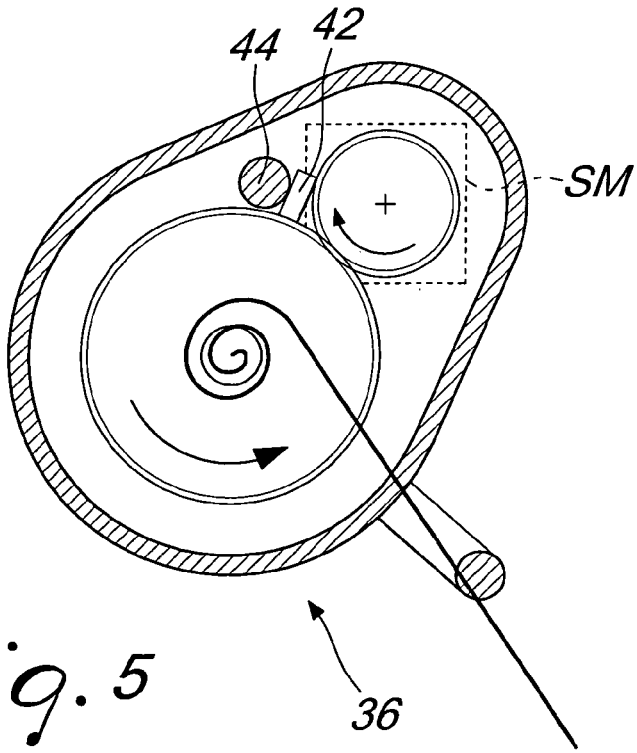
FIG. 5 is a view similar to FIG. 4 but showing the tension-limiting device in a different operative configuration.

According to this invention, with particular reference to FIGS. 4, 5, the inner end 32 of spring 24 is coaxially attached to an output shaft 34 of a ratio-motor 36 fixed to housing 12 of the feeder. Ratio-motor 36 is driven by a stepping motor SM which is operatively connected to control unit CPU (see also FIG. 1). Control unit CPU is programmed to control the angular position of ratio-motor 36 in such a way as to adjust the preload of spring 24 depending on the feeding tension, which is set by the operator on the basis of various parameters such as the yarn type, the process, the downstream machine type, and the like.

FIGS. 4 and 5 show the interior of ratio-motor 36 in detail, in two different operative configurations. Ratio-motor 36 comprises a driving gear 38, which is attached to the driving shaft of motor SM and meshes with a driven gear 40, to which output shaft 34 of the ratio-motor is connected. Driven gear 40 has a projection 42 arranged to abut against an abutment 44 in both the direction of rotation, thereby substantially limiting the rotational stroke of the gear to one revolution. Spring 24 is attached to driven gear 40 at a position such that, when projection 42 abuts on one side of abutment 44, the spring is substantially released (FIG. 4) and arm 26 abuts on stop 30. Each step of rotation of motor SM corresponds to a predetermined preload on the spring, up to a condition of maximum preload in which projection 42 abuts on the opposite side of abutment 44 (FIG. 5). Of course, the relation between the preload on the spring and the deriving tensions may be experimentally measured in a conventional way in the field.

Figure 6:
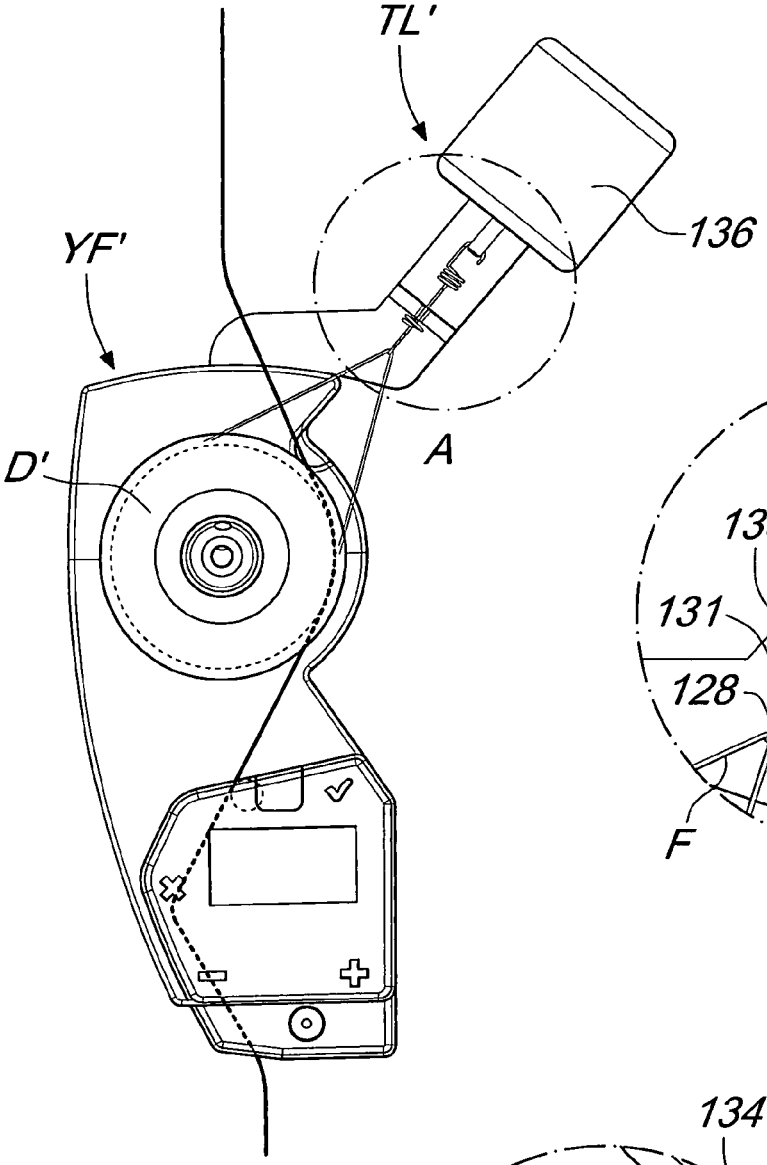
FIG. 6 is a detailed front view of the positive yarn feeder with tension-limiting device according to an alternative embodiment of the invention.
Figure 7:
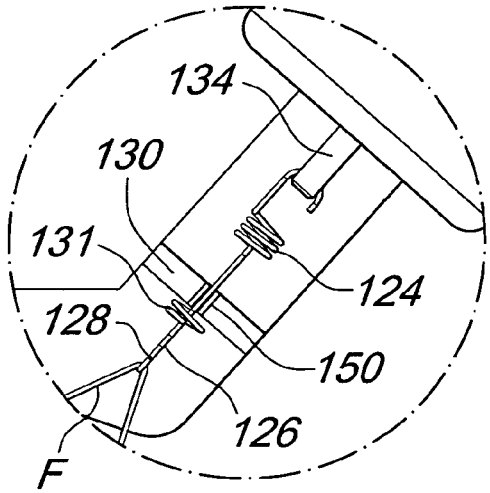
FIG. 7 shows a detail of FIG. 6 to an enlarged scale.
Figure 8:
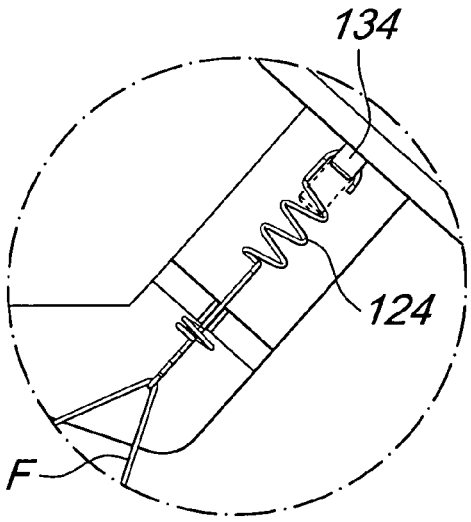
FIG. 8 shows the detail of FIG. 7 in a different operative configuration.

FIGS. 6-8 show an alternative embodiment of tension-limiting device TL', which is based on the same principles described above and is applicable to the same type of positive yarn feeder YF'.

Having particular reference to FIG. 7, tension-limiting device TL' comprises a spiral spring 124 having one end which projects into a guiding member 126 which passes through a slot 150 formed on a transverse wall 130 and terminates with a hook-shaped end 128 engaging the yarn unwinding from drum D'. Upstream of hook-shaped end 128, guiding member 126 has a turn 131 adapted to abut against wall 130, which, accordingly, defines a stop for guiding member 126.

Similarly to the previous embodiment, the yarn unwinding from drum D' is deviated from its natural path, thereby forming a reserve which will be temporarily releasable during the starting transients of the feeding process.

In particular, guiding member 126, subject to the tension of the yarn, will be pulled outwards in contrast to the elastic return action applied by spring 124, thereby releasing the yarn forming the reserve. At this stage, the yarn is subject to a tension depending on the preload on spring 124.

The opposite end of spring 124 is connected to an operating rod 134 of a linear actuator 136 connected operatively to control unit CPU. The latter, likewise the previous embodiment, is programmed to control the position of actuator 136 such as to automatically adjust the preload on spring 124 on the basis of the feeding tension.

The positions of the various parts of the device are designed such that, with the actuator at its outer stop position, the spring is substantially released (FIGS. 6, 7). Each inner position of the actuator corresponds to a predetermined preload on the spring, up to the condition of maximum preload in which the actuator reaches the opposite stop position (FIG. 8). Also in this case, the relation between the preload on the spring and the deriving tensions may be experimentally measured in a conventional way in the field.

A few preferred embodiments of the invention have been described herein, but of course many changes may be made by a person skilled in the art within the scope of the claims. For example, in the first embodiment the stepping motor could be replaced by other motor means, e.g., a brushless motor with feedback control, by techniques falling within the normal knowledge of the person skilled in the art. Similarly, in the second embodiment the linear actuator could also be replaced by other driving means having a linear stoke, such as a stepping/brushless motor coupled with a screw gearing. Although in the above-described embodiments the guiding member is made enbloc from the spring, of course it could be formed as a separate part. Moreover, the shape and the size of the guiding member can be extensively varied, any mechanical member being suitable as far as it is capable of slideably engaging the yarn unwinding from the drum and deviating its path in contrast to the tension of the yarn. Of course, in the second embodiment the spiral spring can be replaced by any other technically equivalent, elastic member acting by traction, such as a rubber rope, and the like.

The disclosures in European Patent Application No. 08425821.9 from which this application claims priority are incorporated herein by reference.

What is claimed is:

1. A positive yarn feeder, comprising:

a motorized yarn-winding drum adapted to have a plurality of loops of yarn wound thereon and driven to rotate for drawing said yarn from a reel and feeding said yarn to a general downstream machine, a movable guiding member, which is biased to slideably engage the yarn unwinding from the drum and to deviate a path of the yarn by a spring acting in contrast to the tension of the yarn, thereby generating a reserve releasable in response to tension peaks on the yarn, a stop that defines a position of maximum deviation of the yarn by limiting a stroke of said guiding member, driving means operable for applying a load to the spring with the guiding member abutting against said stop, and a control unit for controlling said driving means, which is programmed to adjust said load as a function of a desired feeding tension, said spring having one end operatively connected to the guiding member and an opposite end connected to the driving means, and said driving means comprising a linear actuator having an operating rod, said spring being a coil spring suitable to act by traction and having a first end attached to said operating rod of said linear actuator, said coil spring having a second end that is arranged opposite to said first end, said guiding member being attached to said second end.

2. The positive yarn feeder of claim 1, wherein said guiding member has a radial enlargement and said stop consists of a wall, which has a slot in which said guiding member is inserted, and against which said radial enlargement abuts with the guiding member in said position of maximum deviation of the yarn.

3. The positive yarn feeder of claim 1, wherein said guiding member is made enbloc with said spiral spring.

* * * * *